US005692630A

United States Patent [19]

Hsu

[11] Patent Number: 5,692,630

[45] Date of Patent: Dec. 2, 1997

[54] ADJUSTABLE HANDLE OF FEEDING BOTTLE FOR INFANTS AND CHILDREN

[76] Inventor: Shen-kwang Hsu, 6th Fl., No. 87, Chulun St., Taipei, Taiwan

[21] Appl. No.: 593,375

[22] Filed: Jan. 29, 1996

[51] Int. Cl.[6] ..... B65D 23/10; A61J 9/00

[52] U.S. Cl. ..... 215/396; 215/386; 215/11.1; 220/772; 294/30; 294/31.2

[58] Field of Search ..... 215/396, 161, 215/386; 220/772, 758; 294/31.2, 30

[56] References Cited

U.S. PATENT DOCUMENTS

| | | | |
|---|---|---|---|
| 1,838,348 | 12/1931 | Woodman | 294/31.2 |
| 2,421,509 | 6/1947 | Knapp | 294/31.1 |
| 2,789,002 | 4/1957 | Nicholas | 215/31.2 X |
| 3,143,266 | 8/1964 | Imatake | 294/31.2 X |
| 3,194,461 | 7/1965 | Tupper | 294/31.2 X |
| 3,857,598 | 12/1974 | Jelich | 294/31.2 X |
| 3,964,126 | 6/1976 | Madsen | 294/31.2 |
| 3,990,596 | 11/1976 | Hoftman | 215/396 X |
| 4,305,584 | 12/1981 | Leehan | 294/31.2 X |
| 4,941,579 | 7/1990 | Lee | 215/396 X |
| 5,038,948 | 8/1991 | Signorini | 215/396 X |

*Primary Examiner*—Sue A. Weaver

*Attorney, Agent, or Firm*—Sixbey, Friedman, Leedom & Ferguson, PC; Stuart J. Friedman

[57] ABSTRACT

An adjustable handle of feeding bottle for infants and children comprises two grips each having at least one first collar integrally formed thereon, said grips being slidingly disposed between an attachment, e.g. a cover or a securing ring, and a body of the feeding bottle, wherein said grips each further comprise a second collar formed thereon and a kink sized and spaced to receive a peripheral wall of an opposite second collar. In another embodiment, an adjustable handle of feeding bottle for infants and children comprises a first handle having an inner-collar integrally formed thereon, said collar having a circumferential track defined in an outside wall thereof, and a second handle having an outer-collar integrally formed thereon, said outer-collar slidingly received in said circumferential track of said inner-collar, whereby, said first and second handles are disposed between an attachment and a body of the feeding bottle.

5 Claims, 4 Drawing Sheets

ADJUSTABLE HANDLE OF FEEDING BOTTLE FOR INFANTS AND CHILDREN

BACKGROUND OF THE INVENTION

1. Field of The Invention

The present invention relates to a feeding bottle for infants and children, more particularly to an adjustable handle of feeding bottle.

2. Description of Related Art

It is well known that feeding bottles for infants and children are in popular use nowadays. Conventional feeding bottles generally have either one handle or two handles oppositely disposed. Since this kind of handle of a feeding bottle is fixedly disposed and thus not adjustable, it has a disadvantage that it is not convenient for use for children of various ages, such as from six months to three or four years old.

The present invention therefore is aimed to provide a adjustable handle of feeding bottle for infants and children to mitigate and/or obviate the aforementioned problems.

SUMMARY OF THE INVENTION

One object of the present invention is to provide a handle of a feeding bottle for infants and children, the relative position of which can be adjusted according to requirement.

In accordance with one aspect of the present invention, the adjustable handle of the feeding bottle for infants and children comprises two handles each having at least one collar integrally formed thereon, said handles being slidingly disposed between a securing ring and a container of the feeding bottle.

In accordance with another aspect of the present invention, the adjustable handle of feeding bottle for infants and children comprises a first handle having an inner-collar integrally formed thereon, said inner collar having a circumferential track defined in an outside periphery thereof, and a second handle having an outer-collar integrally formed thereon, said outer-collar received in said circumferential track of said inner-collar, whereby, said first and second handles are disposed between a cover and a body of the feeding bottle.

In accordance with a further aspect of the present invention, said outer-collar of the second handle defines a gap.

Other objects, advantages, and novel features of the invention will become more apparent from the following detailed description when taken in conjunction with the accompanying drawings.

DETAILED DESCRIPTION OF PREFERRED EMBODIMENT

Figure 1:
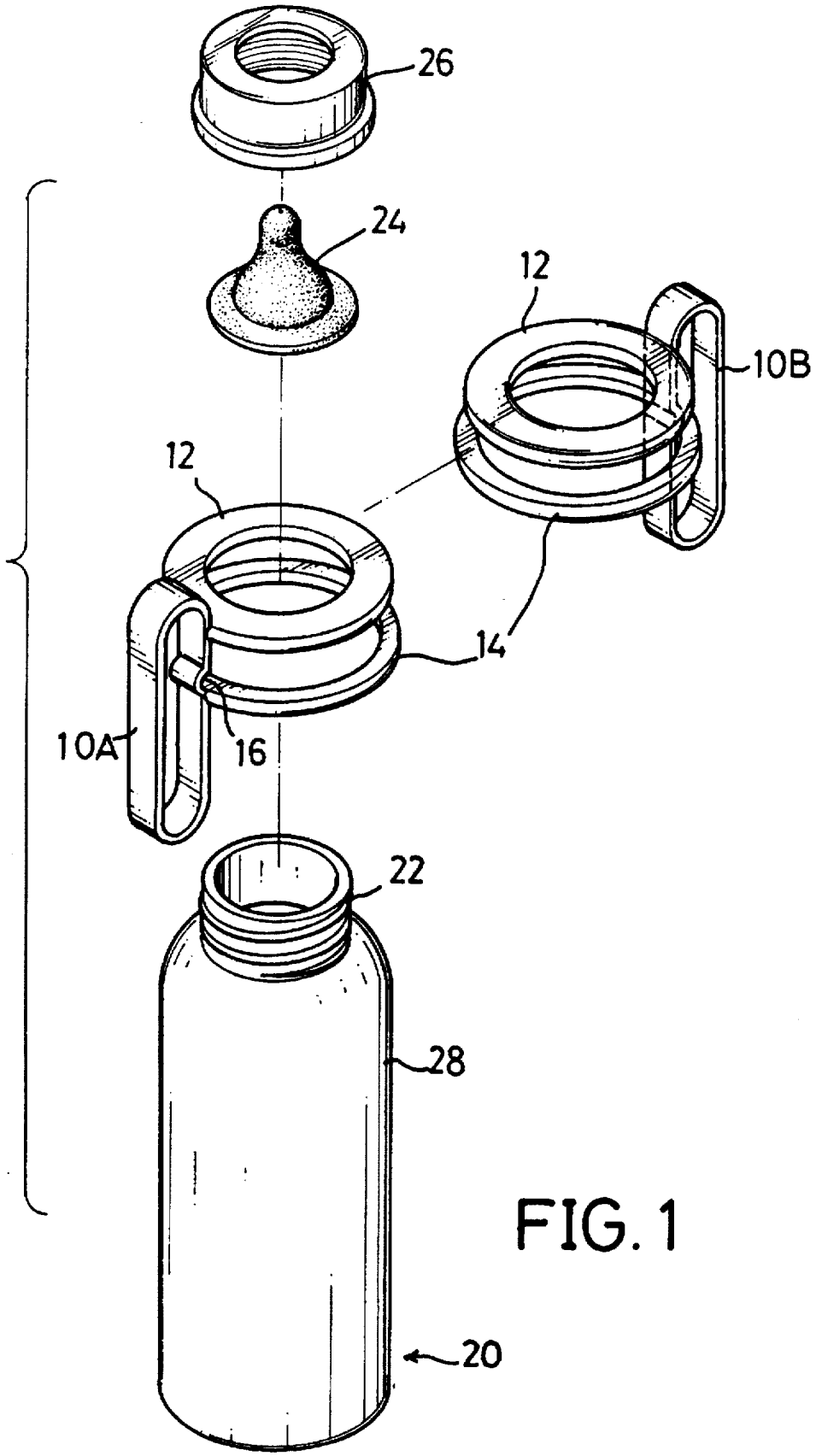
FIG. 1 is an exploded view of a first preferred embodiment in accordance with the present invention.

Referring to FIG. 1, there is shown a first preferred embodiment in accordance with the present invention. An adjustable handle of this invention can be assembled on feeding bottles for infants and children which are in common use and include a container 20, a nipple 24 and a securing ring 26. The container 20 includes a body 28, a closed bottom end and a neck 22 with an inner periphery of the neck 22 defining an opening and a thread being formed on an outer periphery of the neck 22.

Figure 2:
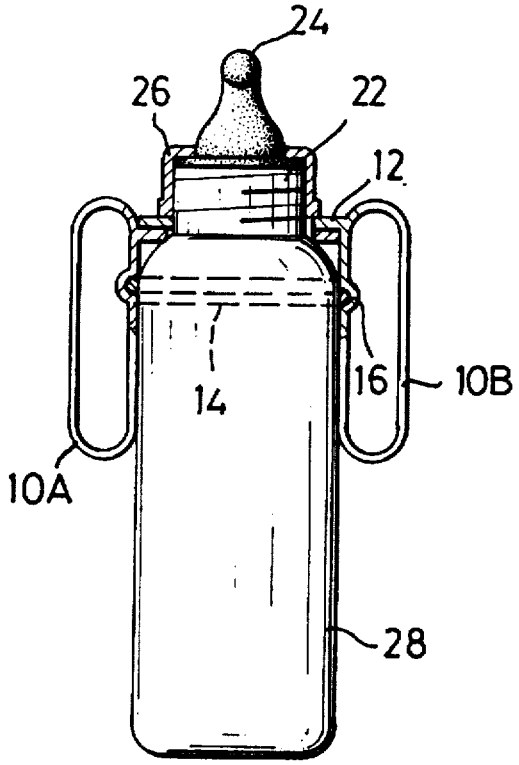
FIG. 2 is a side view, partly in section, the embodiment of FIG. 1.
Figure 3:
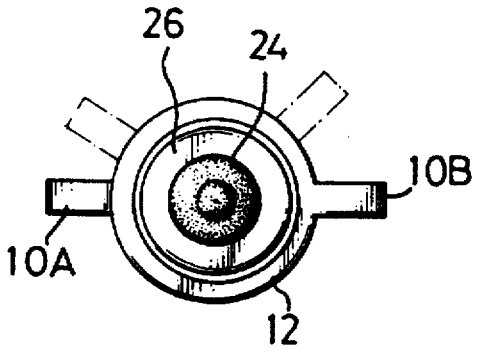
FIG. 3 is a top view showing the adjustment operation of the handles of FIG. 1.

The adjustable handle comprises a first grip 10A and a second grip 10B. Each of the grips 10A, 10B comprises an elongate loop portion, a top collar 12 and a bottom collar 14. The elongate loop portion includes a u-shaped bottom, an inverted u-shaped top and a first wall and a second wall integrally extending therebetween. Each top collar 12 extends perpendicularly and integrally from the second wall near a top of the loop portion and defines an opening sized to receive the neck 22 of the container 20. An outer diameter of the top collar 12 is substantially the same as a diameter of the body 28 of the container 20. Each bottom collar 14 extends perpendicularly and integrally from a mediate portion of the second wall and has a peripheral wall defining an opening sized to receive a diameter of the body 28. It is to be noted that the bottom collars 14 provide a strengthening function to the respective first and second grips 10A, 10B. A kink 16 extending towards the first wall is formed in each second wall of the grips 10A, 10B and is sized and disposed such that the peripheral wall of each opposite collar 14 can be received therein. In assembly, as shown in FIG. 2, the first grip 10A and second grip 10B are disposed on the container 20 and slidingly retained in position by the securing ring 26 being threadedly engaged with the neck 22, whereby the grips 10A, 10B can be rotated to suit a user's requirement, as shown in FIG. 3.

Figure 4:
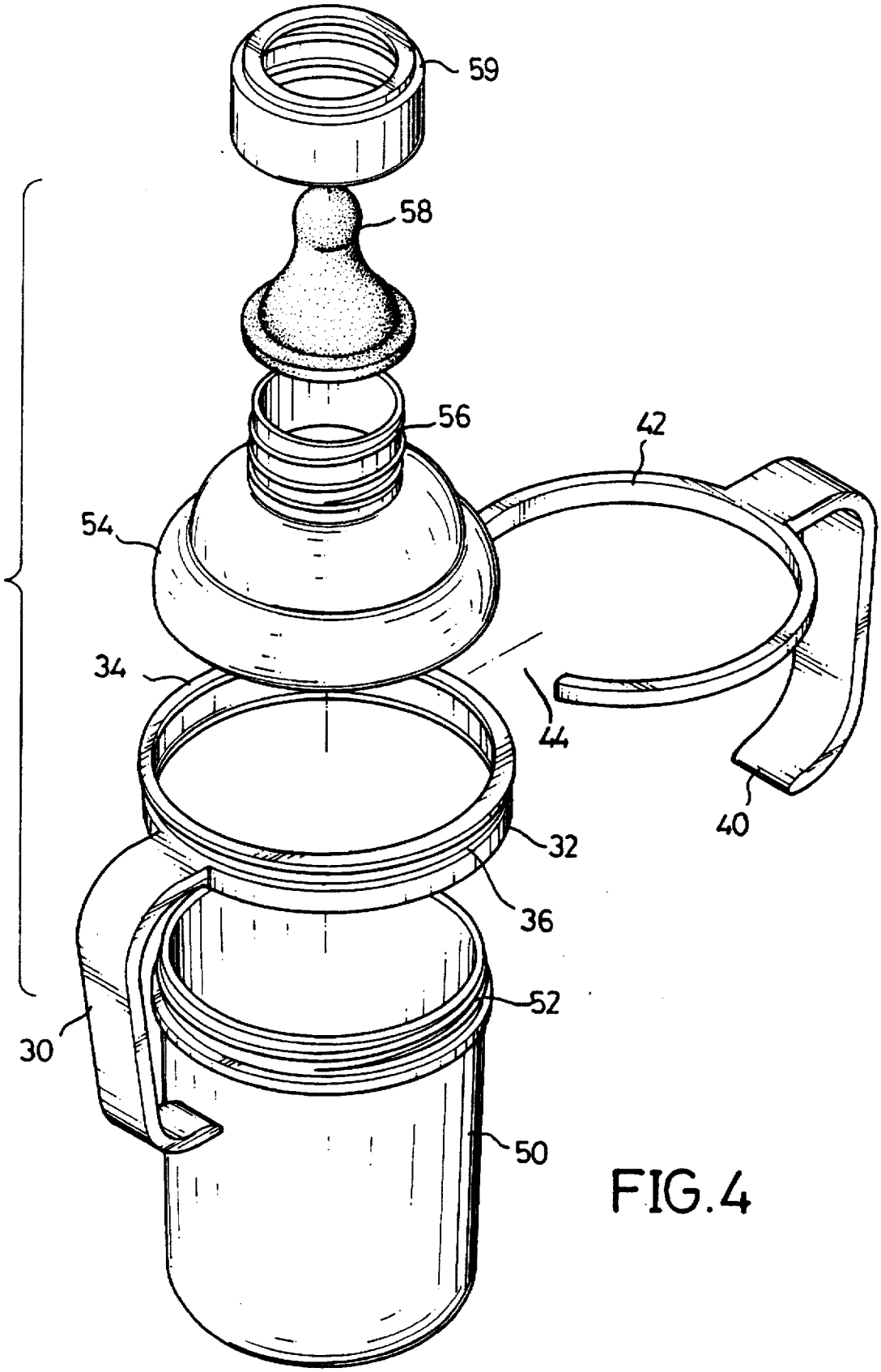
FIG. 4 is an exploded view of a second preferred embodiment in accordance with the present invention.

Referring to FIG. 4, there is shown a second preferred embodiment in accordance with the present invention. The adjustable handle of this invention can be assembled on another feeding bottle for infants and children which is in common use and comprises a body 50, a cover 54, a nipple 58 and a securing ring 59. The adjustable handle comprises a first grip 30 having an inner-collar 32 perpendicularly and integrally formed at a top end thereof, said inner-collar 32 having a circumferential track 36 defined in an outside periphery thereof, and a second grip 40 having a c-shaped outer-collar 42 perpendicularly and integrally formed at a top end thereof, said outer-collar 42 sized and shaped to be slidingly received in said circumferential track 36 of said inner-collar 32. To retain the cover 54 to the body 50 of the feeding bottle, the first grip further comprises a flange 34 projecting inwardly from the top of the inner-collar 32. Additionally, the outer-collar 42 of the second grip 40 defines a gap 44 such that an intrinsic elastic characteristic allows the c-shaped outer-collar 42 to be expanded in a process of fitting it around the inner collar and being received in the circumferential track 36.

Figure 5:
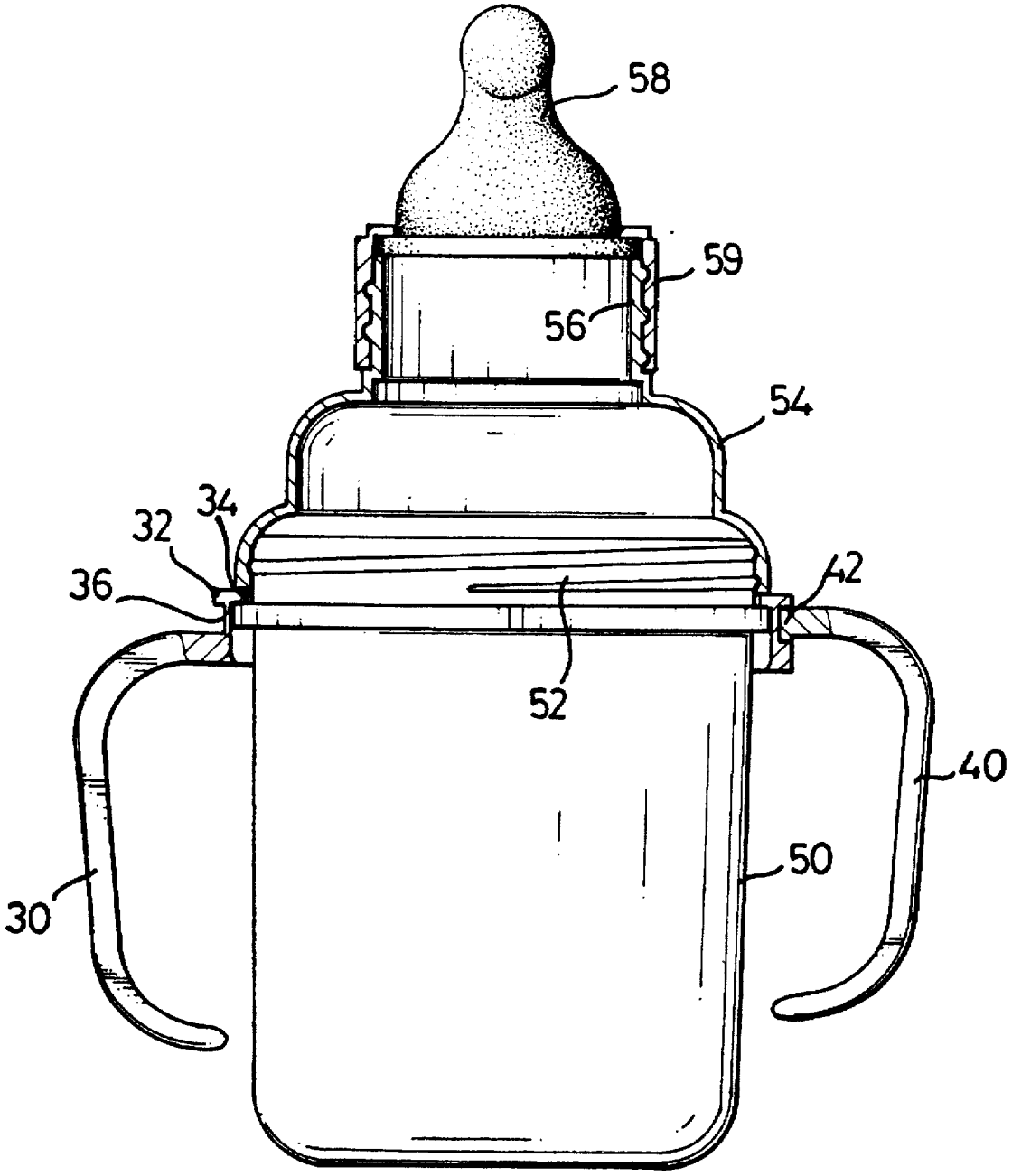
FIG. 5 is a side view, partly in section, of the embodiment of FIG. 4.

With a reference to FIG. 5, which is a side view showing an assembled structure of the handle of feeding bottle of FIG. 4, the two grips 30, 40 are disposed in common between the cover 54 and the body 50 of the feeding bottle 20, wherein the cover 54 of the bottle is threadedly mounted on an open end 52 of the bottle, the securing ring 59 is threadedly mounted on an open end 56 of the cover 54. By this arrangement, the outer-collar 42 of the second grip 40 can be slidingly moved in the circumferential track 36 of the first grip 30, thereby an adjustable effect is provided.

It is to be understood, however, that even though numerous characteristics and advantages of the present invention have been set forth in the foregoing description, together with details of the structure and function of the invention, the disclosure is illustrative only, and changes may be made in detail.

What the invention claimed is:

1. An adjustable handle for a feeding bottle having a body closed at one end and a neck at the opposite end, said neck having an opening formed therein for liquid flow therethrough, and securing means, including a drinking aperture therein, for substantially closing the opening in the neck, comprising:

attachment means having a first grip and a second grip, each of said grips having one of two circumferential upper collars formed thereto and one of two circumferential lower collars formed thereto, each of said upper collars defining an inner diameter slightly larger than an outer diameter of said neck and each of said lower collars defining an inner diameter slightly larger than an outer diameter of said body, said attachment means being secured to said feeding bottle with said upper collars disposed between said body and said securing means.

2. An adjustable handle as claimed in claim 1, wherein said first and second grips each have a kink formed therein for receiving an outer periphery of the lower collar of the opposite grip.

3. An adjustable handle for a feeding bottle having a body, an opening formed therein for liquid flow therethrough and securing means, including a drinking aperture therein, for substantially closing the opening in said body, comprising:

attachment means comprising a first grip and a second grip, said first grip having a ring formed thereto, said ring defining an inner diameter slightly larger than an outer diameter of said body and receivable therearound, said second grip having a clasp sized to be slidably receivable on an outer diameter of said ring, said attachment means being secured to said feeding bottle with said ring disposed between said body and said securing means.

4. An adjustable handle as claimed in claim 3, wherein said clasp is C-shaped.

5. An adjustable handle as claimed in claim 4, wherein said ring defines a circumferential track in an outer wall thereof and said C-shaped clasp is slidably received in said track.

* * * * *